US007681580B2

(12) United States Patent
Yoon et al.

(10) Patent No.: US 7,681,580 B2
(45) **Date of Patent: *Mar. 23, 2010**

(54) WATER RECIRCULATOR IN DISHWASHER

(75) Inventors: Sang Heon Yoon, Seoul (KR); Nung Seo Park, Incheon (KR); Dae Yeong Han, Seoul (KR); Si Moon Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 12/270,471

(22) Filed: Nov. 13, 2008

(65) Prior Publication Data

US 2009/0120470 A1 May 14, 2009

Related U.S. Application Data

(63) Continuation of application No. 10/988,510, filed on Nov. 16, 2004, now Pat. No. 7,464,720.

(30) Foreign Application Priority Data

May 28, 2004 (KR) ..... 10-2004-0038112

(51) Int. Cl.
*B08B 3/04* (2006.01)

(52) U.S. Cl. ..... 134/104.1

(58) Field of Classification Search ..... 134/104.1
See application file for complete search history.

(56) References Cited

U.S. PATENT DOCUMENTS

| | | | | |
|---|---|---|---|---|
| 4,392,891 | A | 7/1983 | Meyers | |
| 5,165,433 | A | 11/1992 | Meyers | |
| 5,433,232 | A | 7/1995 | Young, Jr. | |
| 5,601,660 | A | 2/1997 | Jeon et al. | |
| 5,779,812 | A * | 7/1998 | Thies et al. | 134/10 |
| 5,848,601 | A | 12/1998 | Thies | |
| 6,182,674 | B1 | 2/2001 | Jozwiak et al. | |
| RE37,831 | E | 9/2002 | Thies | |
| 2003/0006305 | A1 | 1/2003 | Hegeman et al. | |
| 2005/0051201 | A1 | 3/2005 | Ashton et al. | |

FOREIGN PATENT DOCUMENTS

| | | |
|---|---|---|
| GB | 2038171 | 7/1980 |
| KR | 20-0196942 | 2/2000 |

OTHER PUBLICATIONS

English language Abstract of KR 20-0196942, Feb. 15, 2000.

* cited by examiner

*Primary Examiner*—Frankie L Stinson
*Assistant Examiner*—Samuel A Waldbaum
(74) *Attorney, Agent, or Firm*—McKenna Long & Aldridge LLP

(57) ABSTRACT

A water recirculator in a dishwasher supplies water to spray arms for washing dishes and also purifies contaminated water after washing the dishes. The water recirculator includes a sump for holding water, a water supply pump connected to the sump, a guide passage for guiding a portion of the water pumped by the water supply pump to a spray arm in a washing chamber, a pre-filtering unit for purifying a rest of the water pumped by the water pumped by the water supply pump by means of precipitating contaminants included in the water therein, and a main filtering unit for purifying the rest of the water passed through the pre-filtering unit.

13 Claims, 7 Drawing Sheets

WATER RECIRCULATOR IN DISHWASHER

CROSS-REFERENCE TO RELATED APPLICATIONS

This application is a continuation of U.S. patent application Ser. No. 10/988,510, filed on Nov. 16, 2004, which claims benefit of priority of the Korean Application No. 10-2004-0038112, filed on May 28, 2004, the contents of which are expressly incorporated by reference in its entirety.

BACKGROUND OF THE INVENTION

1. Field of the Invention

The present invention relates to a dishwasher, and more particularly, to a water recirculator in a dishwasher, wherein the dishwasher is provided with a compact water recirculator through which filtered washing water can be supplied for washing articles placed within a washing chamber.

2. Background of the Related Art

A conventional dishwasher automatically washes and dries dishes (or articles) to be washed, by spraying water mixed with detergent onto the articles, which are placed on one or more racks installed inside a washing chamber, and then supplying hot air to the washing chamber. Herein, the dishes include all types of kitchenware, utensils, tableware, and other assorted articles. In general, as shown in FIG. 1, the dishwasher includes racks 6 and 7 for placing the dishes thereon, a sump 1 for holding the washing water, spray arms 4 and 5 for spraying the washing water to the dishes on the racks 6 and 7, and a pump 2 for supplying the washing water from the sump 1 to the spray arms 4 and 5. A drain hose 9 is also included in the conventional dishwasher.

During operation of the dishwasher, when the pump 2 is activated, the spray arms 4 and 5 spray the washing water held (or accommodated) in the sump 1 onto the dishes on the racks 6 and 7, so as to wash the dishes. And, the washing water sprayed to the dishes returns to the sump 1, and is sprayed onto the dishes once again through the pump 2 and the spray arms 4 and 5.

As mentioned above, in the conventional dishwasher, the washing water once used for washing the dishes is returned to the sump 1, and the process of spraying the washing water to the dishes is repeated. Eventually, the washing water in the sump 1 becomes gradually contaminated. Continuous and repeated use of heavily contaminated washing water not only drops the washing capability of the dishwasher, but is also liable to block a passage of the washing water. In order to resolve such problems, the washing water should be changed periodically. However, a frequent change of the washing water may result in an excessive amount of water consumption.

SUMMARY OF THE INVENTION

Accordingly, the present invention is directed to a water recirculator in a dishwasher that substantially obviates one or more of the problems due to limitations and disadvantages of the related art.

An object of the present invention is to provide a water recirculator in a dishwasher that can effectively purify and supply washing water in the dishwasher to a spray arm.

Another object of the present invention is to provide water recirculator in a dishwasher having a compact size.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, a water recirculator in a dishwasher includes a sump for holding water, a water supply pump connected to the sump and pumping the water, a guide passage for guiding a portion of the pumped water to a spray arm in a washing chamber, a pre-filtering unit for precipitating contaminants included in the water to purify a rest of the pumped water, and a main filtering unit for purifying the rest of the pumped water passed through the pre-filtering unit.

The main filtering unit may include a reservoir for holding the rest of the water passed through the pre-filtering unit, and a main filter provided above the reservoir for purifying the water which overflows from the reservoir and returns to the sump. The pre-filtering unit may include a bypass for guiding the rest of the water pumped by the water supply pump to the main filtering unit, and a precipitate vessel provided at a middle of the bypass, the precipitate vessel having a spacious inner space for precipitating contaminants in the water therein. In this case, the precipitate vessel may include a drain pump provided at a middle of the bypass, and connected to the sump for being capable of draining the water in the sump. And, the precipitate vessel may be disposed below the main filtering unit. The pre-filtering unit may further include a supplementary filter provided in the precipitate vessel, for purifying the water which moves to the main filtering unit from the precipitate vessel. The water recirculator may further include a supplementary bypass being capable of making the sump to be communicated with the pre-filtering unit when water pressure in the main filtering unit is higher than a predetermined water pressure.

In another aspect of the present invention, a water recirculator in a dishwasher includes a sump for holding water, a water supply pump connected to the sump and pumping the water, a housing including a guide passage for guiding a portion of the pumped water to a spray arm in a washing chamber, and a reservoir provided at the same height as the guide passage and for holding water, a bypass for guiding a rest of the pumped water to the reservoir, a drain pump provided at a middle of the bypass for purifying water which moves to the reservoir from the guide passage and connected to the sump for be capable of draining the water in the sump, and a cover provided on the housing, the cover including a main filter for purifying the water which overflows from the reservoir and returns to the sump.

In this case, the drain pump may precipitate contaminants included in the water therein to purify the rest of the pumped water. The water recirculator may further include a supplementary bypass being communicated with the bypass and the sump for being capable of making the bypass to be communicated with the sump when water pressure in the reservoir is higher than a predetermined water pressure. And, the water recirculator may further include a supplementary filter provided in the drain pump for purifying the water which is pumped by the water supply pump and which moves to the reservoir. In this case, the supplementary filter may be coarser than the main filter. The cover may further include at least one hole for guiding the water, which is passed through the main filter or which is fallen from the washing chamber, to the sump. And, the cover may cover the reservoir and the guide passage. Meanwhile, the drain pump may be disposed below the housing.

In a further aspect of the present invention, a water recirculator in a dishwasher includes a sump for holding water, a water supply pump connected to the sump and pumping the water, a housing including a guide passage for guiding a portion of the pumped water to a spray arm in a washing chamber and a reservoir provided on the guide passage for holding water, a bypass for guiding a rest of the pumped water to the reservoir, a drain pump provided at a middle of the bypass for purifying water which moves to the reservoir and connected to the sump for being capable of draining the water in the sump, and a cover on and covering the reservoir and including a main filter for purifying the water which overflows from the reservoir and returns to the sump.

In this case, the drain pump may precipitate contaminants included in the water therein to purify the rest of the pumped water. The water recirculator may further include a supplementary bypass being communicated with the bypass and the sump for being capable of making the bypass to be communicated with the sump when water pressure in the reservoir is higher than a predetermined water pressure. And, the water recirculator may further include a supplementary filter provided in the drain pump for purifying the water which is pumped by the water supply pump and moves to the reservoir. In this case, the supplementary filter may be coarser than the main filter. The water recirculator may further include at least one hole for guiding the water which is passed through the main filter or which is fallen from the washing chamber to the sump. The drain pump may be disposed below the housing. The guide passage may be covered by a lower part of the reservoir. And, the guide passage may pass through a part of the reservoir so as to be communicated with the spray arm. Meanwhile, the reservoir may have a looped curved shape when the reservoir is seen from a top thereof.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments, parts the same with the related art will be given the same names and reference symbols.

Figure 1:
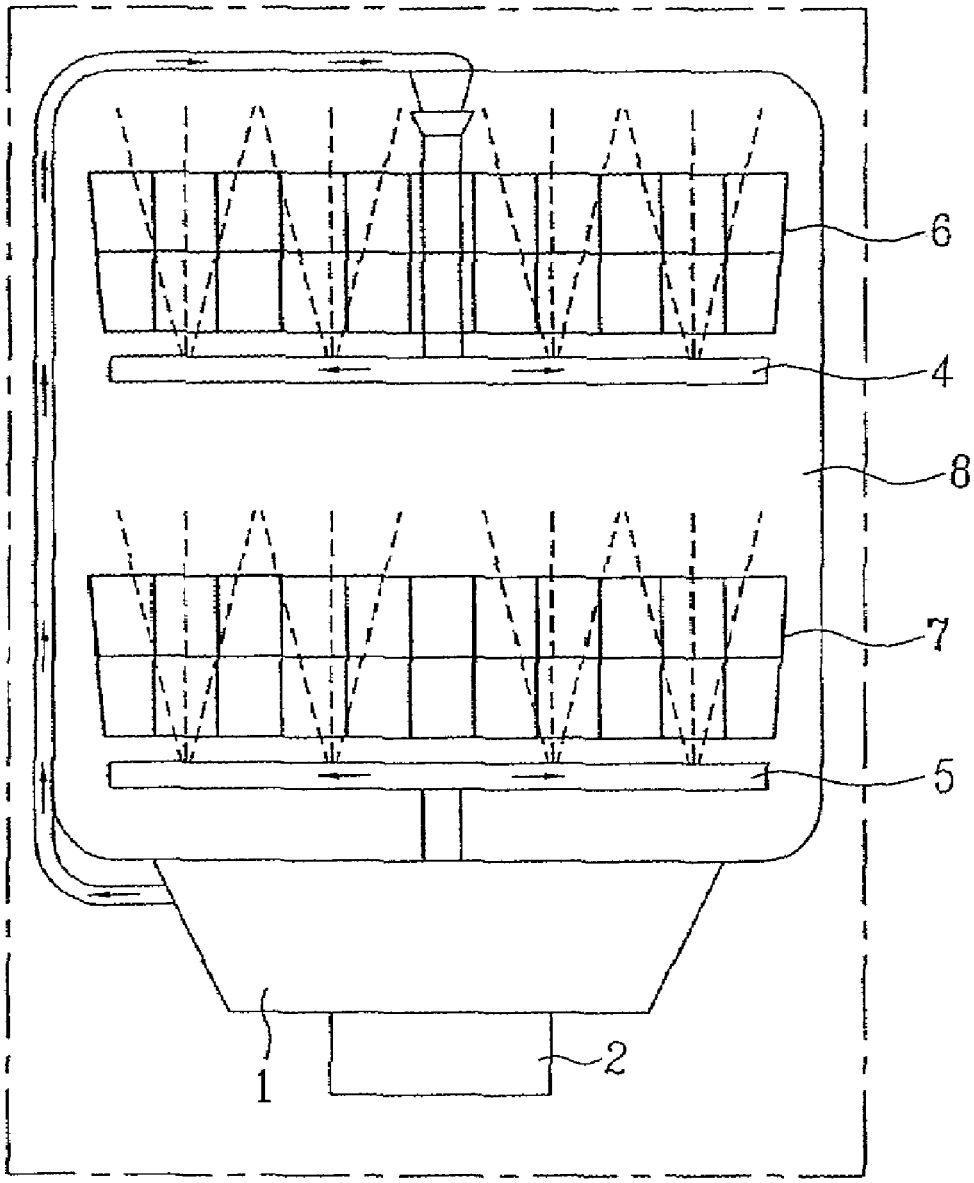
FIG. 1 Related Art
FIG. 1 illustrates a schematic diagram of a general dishwasher.
Figure 2:
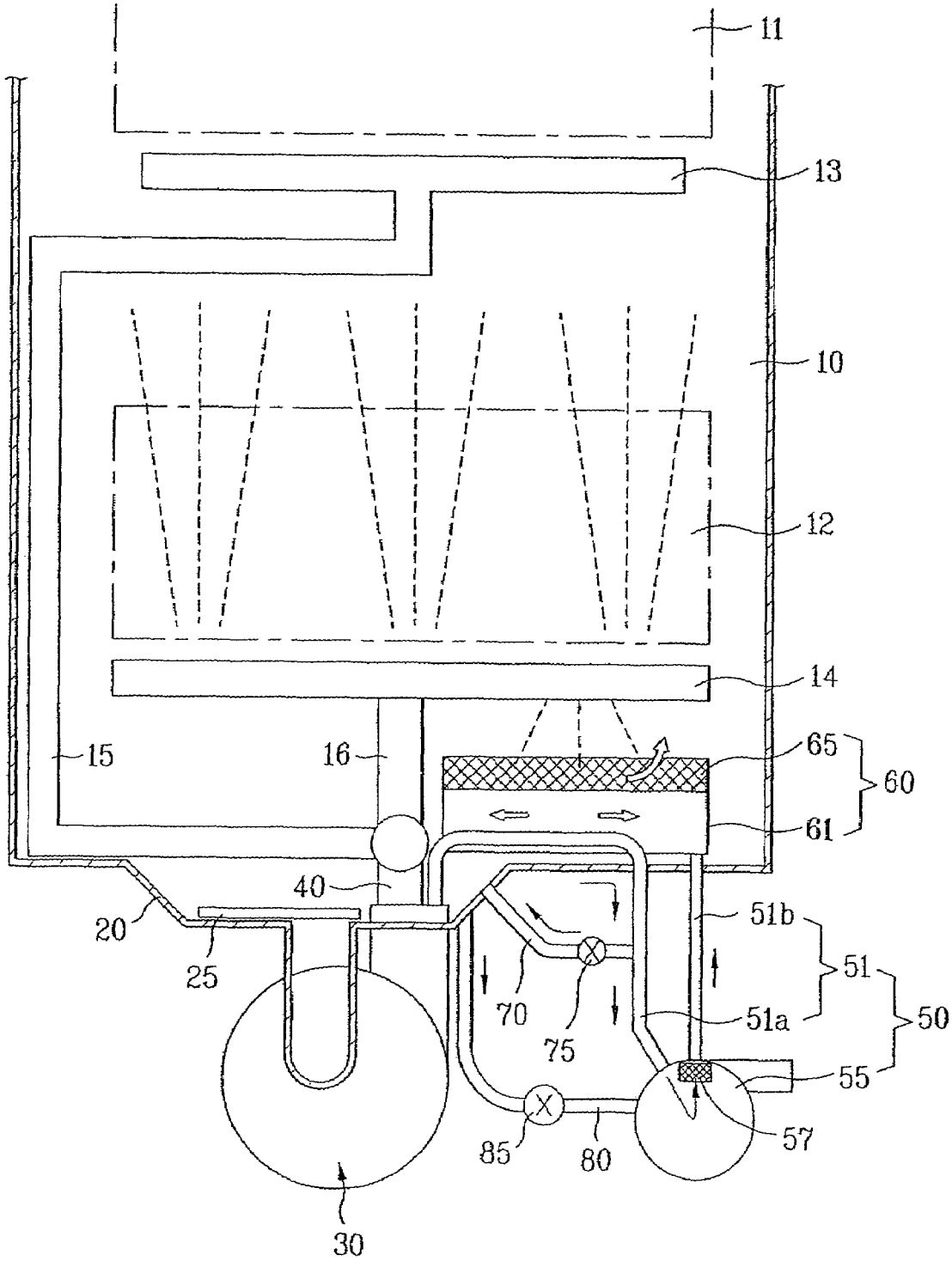
FIG. 2 illustrates a schematic diagram of a dishwasher having a water recirculator according to the present invention.

FIG. 2 schematically illustrates a water recirculator applied in a dishwasher according to the present invention. Referring to FIG. 2, at least one rack for placing dishes thereon is provided in a washing chamber 10 of a dishwasher, and at least one spray arm is formed to be adjacent to the at least one rack for spraying the water to the dishes placed thereon. More specifically, FIG. 2 illustrates an example of two racks (i.e., an upper rack 11 and a lower rack 12) provided in the washing chamber 10 and two spray arms (i.e., an upper spray arm 13 and a lower spray arm 14) provided under the upper rack 11 and the lower rack 12, respectively.

The water recirculator according to the present invention is provided under the washing chamber 10. The water recirculator not only supplies the water to the spray arms (i.e., the upper and lower spray arms 13 and 14) but also purifies the water, which is returned to the water recirculator after washing the dishes in the washing chamber 10. The structure of the water recirculator according to the present invention will be described in detail as follows. A sump 20 is provided in the water recirculator. As shown in FIG. 2, the sump 20 is provided under the washing chamber 10 for holding (or accommodating) the washing water. And the sump 20 not only receives and accommodates the fresh and clean water, which is supplied from outside of the dishwasher during the water supplying process, but also receives and accommodates the contaminated water, which is fallen from the washing chamber 10 after washing the dishes during the washing process.

A water supply pump 30 is connected to the sump 20. The water supply pump 30 pumps up the water accommodated in the sump 20, and supplies the water to the upper and lower spray arms 13 and 14. Herein, the water supply pump 30 includes a motor and an impeller (not shown), the structure of which will be described in detail in a later process. Meanwhile, a portion of the water being pumped by the water supply pump 30 from the sump 20 is supplied to the upper and lower spray arms 13 and 14. Accordingly, a guide passage 40 is provided in the water recirculator, as shown in FIG. 2. The guide passage 40 is connected to an upper connection tube 15, which is connected to the upper spray arm 13, and the guide passage 40 is also connected to a lower connection tube 16, which is connected to the lower spray arm 14. Thus, the portion of the water being pumped by the water supply pump 30 is supplied to the upper and lower spray arms 13 and 14 through the guide passage 40 and the upper and lower connection tubes 15 and 16. And, a rest (or a remaining portion) of the water being pumped by the water supply pump 30 from the sump 20 is purified in the water recirculator. The purified water is then returned to the sump 20.

A pre-filtering unit 50 and a main filtering unit 60 are provided in the water recirculator in accordance with the present invention, as shown in FIG. 2. The pre-filtering unit 50 initially purifies the rest of the water being pumped by the water supply pump 30, so as to remove coarse contaminants included in the rest of the water. The pre-filtering unit 50 includes a bypass 51 guiding the rest of the water pumped by the water supply pump 30 to the main filtering unit 60, and a precipitate vessel at the middle of the bypass 51 for purifying the water passing through the bypass 51. More specifically, the precipitate vessel purifies the water moving to the main filtering unit 60 through the bypass 51 by precipitating the contaminants included in the water. Accordingly, the precipitate vessel should have a spacious inner space therein. The precipitate vessel may be provided as a separate and independent member of the water recirculator according to the present invention, such as a tank having a spacious inner space. However, in order to reduce the number of members and the fabrication cost, the present invention provides a structure, wherein a drain pump 55 is used as the precipitate vessel, as shown in FIG. 2. The drain pump will now be described in more detail.

Generally, the drain pump 55 drains the water in the sump 20, once the water in the sump 20 becomes heavily contaminated after washing the dishes. Accordingly, the sump 20 and the drain pump 55 are communicated with each other through a drain passage 80, and a drain valve 85 is provided at the middle of the drain passage 80 for opening and closing the drain passage 80. The drain valve 85 prevents the water held in the sump 20 from moving to the drain pump 55 during the washing process, and the drain valve 85 introduces the water in the sump 20 to the drain pump 55 only during the draining process. The drain pump 55 generally includes a motor (not shown), an impeller coupled to the motor (not shown), and an impeller housing (not shown) surrounding the impeller. Sufficient space is provided in the impeller housing so as to accommodate the water therein. And, the water accommodated in the impeller housing is drained outside of the dishwasher, when the motor rotates by the impeller. Thus, the impeller housing having a spacious inner space therein, which accommodates the water therein, is adequate to be used as the member for precipitating the contaminants included in the water in order to purify the water. The drain pump 55 is disposed below the main filtering unit 60, as shown in FIG. 2. Then, heavy contaminants are easily precipitated to the bottom of the drain pump 55 due to their own weight, when the rest of the water pumped by the water supply pump 30 moves to the main filtering unit 60 through the drain pump 55.

As described above, the pre-filtering unit 50 purifies the water accommodated in the drain pump 55 by precipitating the contaminants included in the water. However, a supplementary filter 57 may be provided to the pre-filtering unit 50 so as to enhance the filtering capability of the pre-filtering unit 50. The supplementary filter 57 may be formed in the drain pump 55, as shown in FIG. 2. Among the contaminants in the water moving to the main filtering unit 60, the contaminants that are comparatively light and that do not precipitate, due to the pumping pressure of the water supply pump 30, can also be removed by the supplementary filter 57. But, if the supplementary filter 57 filters and removes even the very small and fine contaminants, a water flow line may be clogged and a malfunction may occur in the drain pump 55. Thus, the supplementary filter 57 should include a mesh which is capable of removing the contaminants having a comparatively coarse size (i.e., not too small and not too fine).

The initially purified water having the coarse contaminants removed via the drain pump 55 is supplied to the main filtering unit 60. And, the main filtering unit 60 filters the water and removes smaller and finer contaminants from the water. The main filtering unit 60 then supplies the filtered water to the sump 20. Accordingly, the main filtering unit 60 includes a reservoir 61 for accommodating the contaminated water and contaminants, and a main filter 65 for filtering the contaminated water. The reservoir 61 is connected to the bypass 51, and has a large empty space therein. And, the reservoir 61 receives and accommodates the water introduced thereto through the bypass 51 and the drain pump 55. Since the water supply pump 30 pumps up the water in the sump 20 with a high pressure, the water pumped by the water supply pump 30 can easily reach the reservoir 61. As the water is supplied to the reservoir 61, the water level in the reservoir 61 becomes higher. And, since the reservoir 61 has an open top, the water eventually overflows from the reservoir 61. Then, because the main filter 65 is provided above the reservoir 61, the water overflowing from the reservoir 61 passes through the main filter 65 and is filtered by the main filter 65. Accordingly, the main filter 65 should have a mesh, which can filter small and fine contaminants that have not been precipitated and removed in the drain pump 55. Meanwhile the contaminants, which are filtered by the main filter 65, remain in the reservoir 61.

And, the water overflowed from the reservoir 61 is fallen down after passing through the main filter 65. Then, since the sump 20 is provided below the reservoir 61, the purified water filtered from the main filter 65 eventually returns to the sump 20. And, since the main filter 65 filters even smaller and finer contaminants, the main filter 65 may be clogged when a large amount of the contaminants is filtered. Therefore, the lower spray arm 14 sprays water to the main filter 65, as shown in FIG. 2. Then, the contaminants clinging to the main filter 65 and clogging the main filter 65 are eventually detached (or washed out) from the main filter 65. And, the reservoir 62 then accommodates the contaminants detached from the main filter 65. However, after a long period of washing time and as the accumulated amount of contaminants becomes larger, the main filter 65 may be clogged. In this case, since the water introduced into the reservoir 61 is not likely to pass through the main filter 65, the water pressure in the reservoir 61 may become higher. If the water pressure in the reservoir 61 continues to increase, the main filter 65 is affected by the strong force of the water pressure in the reservoir 61, thereby causing some problems, such as a deformation of the main filter 65. Therefore, the drain pump 55 can drain the contaminated water from the reservoir 61 when the water pressure in the reservoir 61 is higher than (or exceeds) a predetermined water pressure. However, in this case, a large quantity of the water is wasted.

In order to prevent the aforementioned problems, a supplementary bypass 70 is provided to the water recirculator according to the present invention. The supplementary bypass 70 allows the sump 20 to be communicated with the pre-filtering unit 50 and, more particularly, with the bypass 51. And, a valve 75 opening and closing the supplementary bypass 70 is provided at the middle of the supplementary bypass 70. More particularly, the valve 75 usually closes the water flow passage of the supplementary bypass 70, but the valve 75 opens the water flow passage when the water pressure in the reservoir 61 is higher than the predetermined water pressure. Thus, if the water pressure in the reservoir 61 is higher than the predetermined water pressure, since the sump 20 is communicated with the bypass 51 through the supplementary bypass 70, the water passing through the bypass 51 returns to the sump 20 through the supplementary bypass 70, instead of flowing to the reservoir 61. FIG. 2 shows an example of the supplementary bypass 70 being connected to both the sump 20 and a first bypass 51*a*. The first bypass 51*a* supplies the water pumped by the water supply pump 30 to the drain pump 55. However, the supplementary bypass 70 may also be connected to both the sump 20 and a second bypass 51*b*. Herein, the second bypass 51*b* is connected to both the drain pump 55 and the reservoir 61.

Meanwhile, the water recirculator according to the present invention should be formed in a compact size, so that the water recirculator can be competitive in the market. Accordingly, all of the members of the water recirculator according to the present invention including the sump 20, the water supply pump 30, the guide passage 40, the bypass 51, the drain pump 55, the reservoir 61, the main filter 65, and so on, should be systematically assembled. Thus, the present invention provides a well-assembled structure of the water recirculator, which can efficiently filter the water and is also very compact. The structure will now be described in detail.

Figure 3:
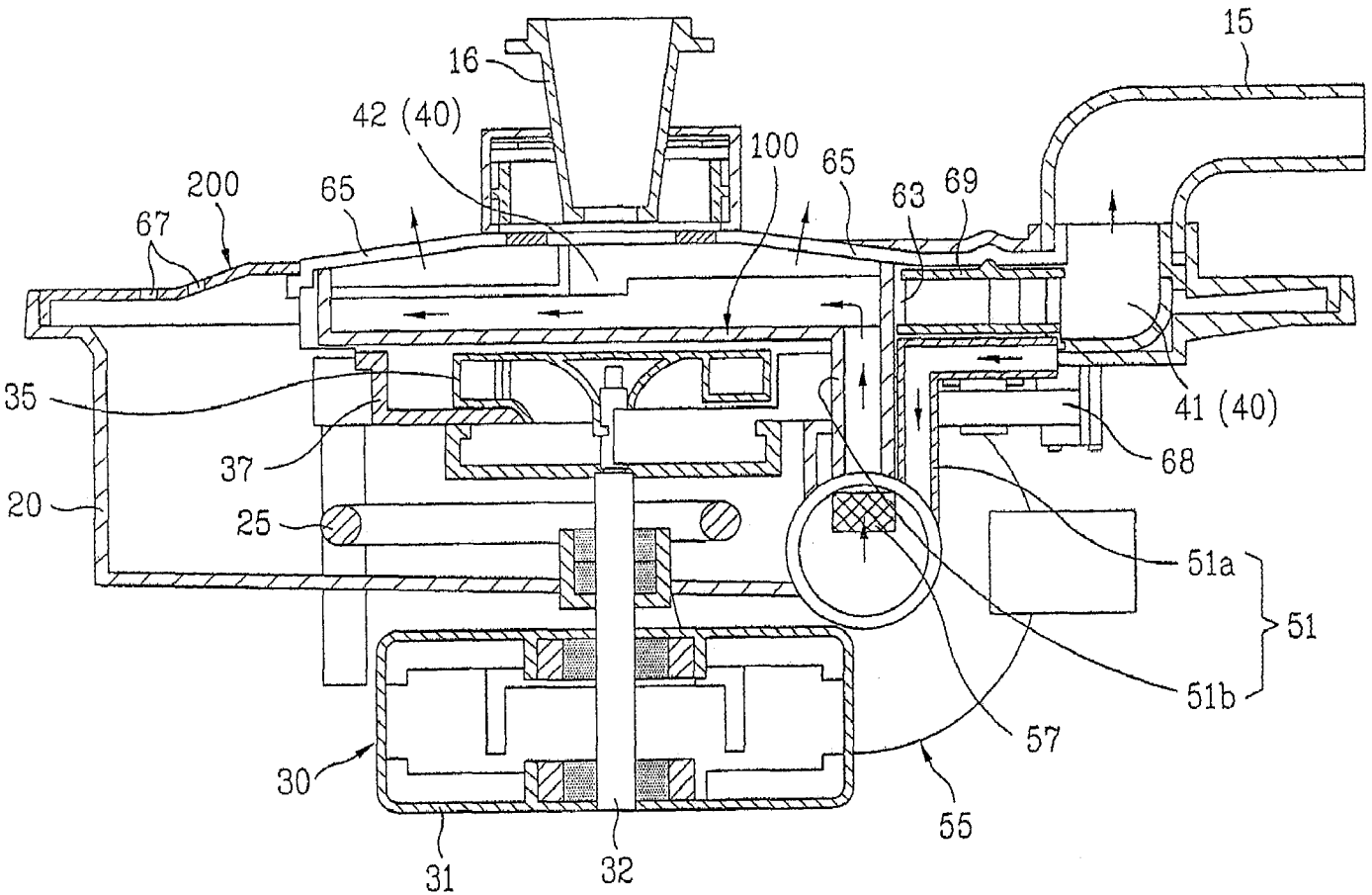
FIG. 3 illustrates a cross-sectional view of the water recirculator according to a first embodiment of the present invention.

FIG. 3 illustrates the water recirculator according to the first embodiment of the present invention. Referring to FIG. 3, a heater 25 for heating the water is provided in the sump 20. The spray arms can then spray the heated water onto the dishes, thereby enhancing the washing capability of the dishwasher. The water supply pump 30 is provided under the sump 20, and the water supply pump 30 is connected to a lower part of the sump 20. The water supply pump 30 includes a motor 31 and an impeller 35. The motor 31 is disposed under the sump 20, and a shaft of the motor 31 passes through the sump 20, as shown in FIG. 3. The impeller 35 is provided in the sump 20 and connected to the shaft of the motor 31. Also, the impeller 35 is surrounded by an impeller housing 37, which has a spacious inner space therein, as shown in FIG. 3.

Figure 4:
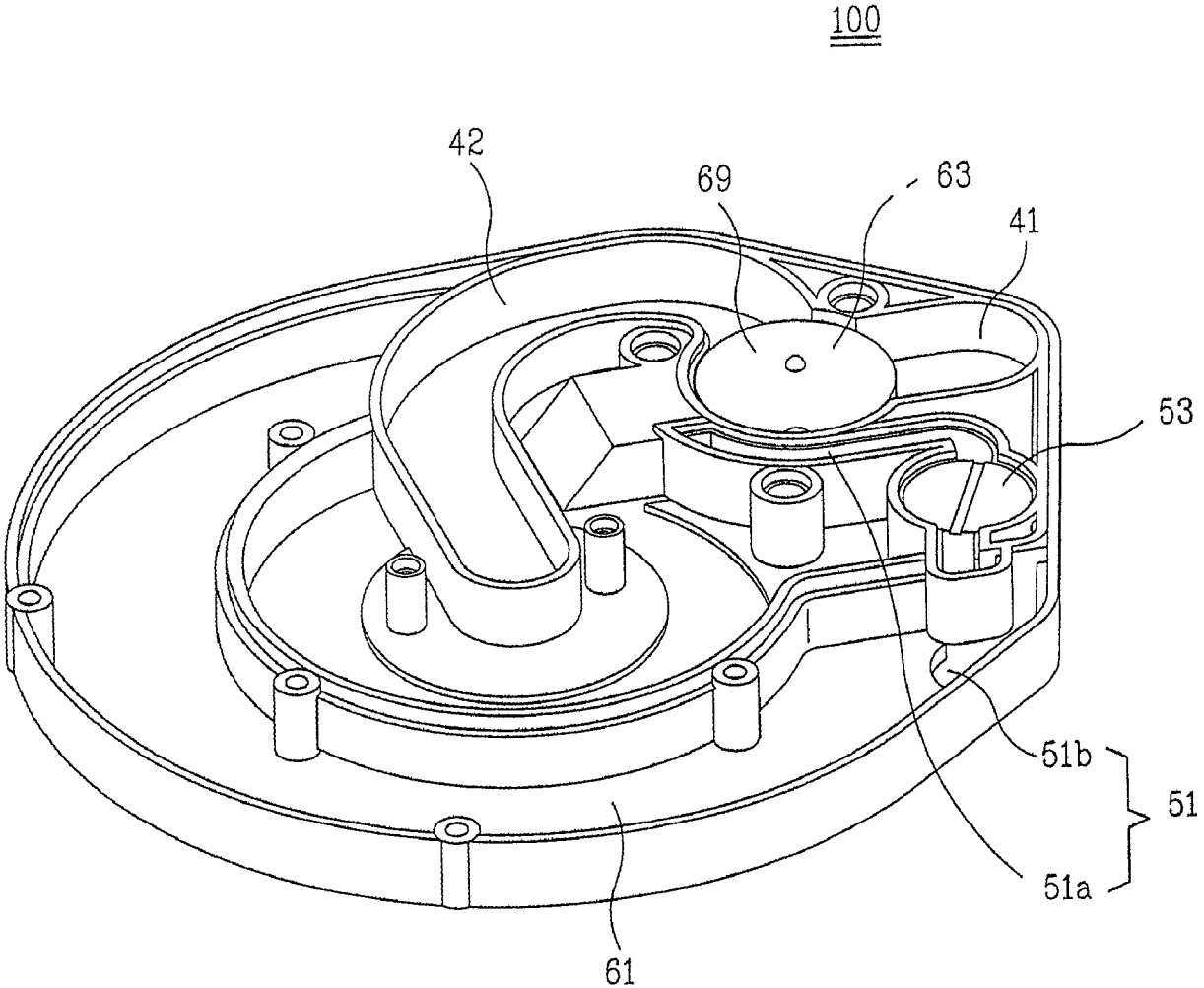
FIG. 4 illustrates a perspective view of a housing of the water recirculator of FIG. 3.

Meanwhile, a housing 100 is provided in an upper part of an inner space of the sump 20. And, the guide passage 40 and the main filtering unit 60 are provided at the housing 100. As mentioned above, the guide passage 40 guides the portion of the water, which is pumped by the water supply pump 30 to the spray arms, and the main filtering unit 60 filters the rest of the water, which is also pumped by the water supply pump 30, and returns the rest of the water to the sump 20. As described above, since two different elements (i.e., the guide passage 40 and the main filtering unit 60) having different functions are provided at the housing 100, the water recirculator according to the present invention can be formed to have a compact size. FIG. 4 illustrates an embodiment of the housing 100 according to the first embodiment of the present invention. The housing will now be described in detail with reference to FIGS. 3 and 4.

As shown in FIG. 3, an inlet 63, which is communicated with the impeller housing 37, is provided at the housing 100. Thus, the water pumped by the water supply pump 30 from the sump 20 is introduced to the inside of the housing 100 through the inlet 63. And, the inlet 63 is also communicated with the guide passage 40. FIG. 4 illustrates an example of two guide passages (i.e., a first guide passage 41 and a second guide passage 42) being communicated with the inlet 63, respectively. In this case, the first guide passage 41 is communicated with the upper connection tube 15, and the second guide passage 42 is communicated with the lower connection tube 16. And, as shown in FIGS. 3 and 4, a portion of the bypass 51, more particularly, a portion of the first bypass 51*a* is communicated with the inlet 63.

In addition, a diverting valve 69 is provided in the inlet 63. Herein, a control motor 68 selectively rotates the diverting valve 69, as shown in FIG. 3, and whereby the inlet 63 is selectively communicated with both or any one of the first guide passage 41 and the second guide passage 42. Thus, the diverting valve 69 selectively guides the water pumped by the water supply pump 30 to both the upper spray arm 13 and the lower spray arm 14 or any one of the upper spray arm 13 and the lower spray arm 14. However, the diverting valve 69 does not control the flow of the water, which moves to the first bypass 51*a* from the inlet 63. Thus, the portion of the water pumped by the water supply pump 30 is selectively guided to both or any one of the upper spray arm 13 and the lower spray arm 14 by the diverting valve 69 and the guide passage 40. On the other hand, the rest of the water pumped by the water supply pump 30 is always introduced to the first bypass 51*a*.

As shown in FIG. 4, a sensor 53 is provided in a portion of the first bypass 51*a*, which is provided in the housing 100. The sensor 53 measures a level of contamination of the water passing through the first bypass 51*a*. Since the sensor 53 has a light emitter (not shown) and a light receiver (not shown), the sensor 53 can determine the level of contamination of the water based on an amount of light received at the light receiver.

Meanwhile, as shown in FIG. 4, the reservoir 61 accommodating the rest of the water, which is introduced to the inlet 63 but not supplied to the upper spray arm 13 or the lower spray arm 14, is provided in the housing 100. The reservoir 61 is provided at the same height as the guide passage 40 (i.e., the first guide passage 41 and the second guide passage 42). Thus, the reservoir 61 and the guide passage 40 occupy the same vertical space of the housing 100. Then, since the volume of the housing 100 can be reduced, the water recirculator according to the present invention can be formed to have a compact size. The reservoir 61 is communicated with the second bypass 51*b*, as shown in FIG. 2. Thus, the water introduced to the first bypass 51*a* is eventually introduced to the inside of the reservoir 61.

Figure 5:
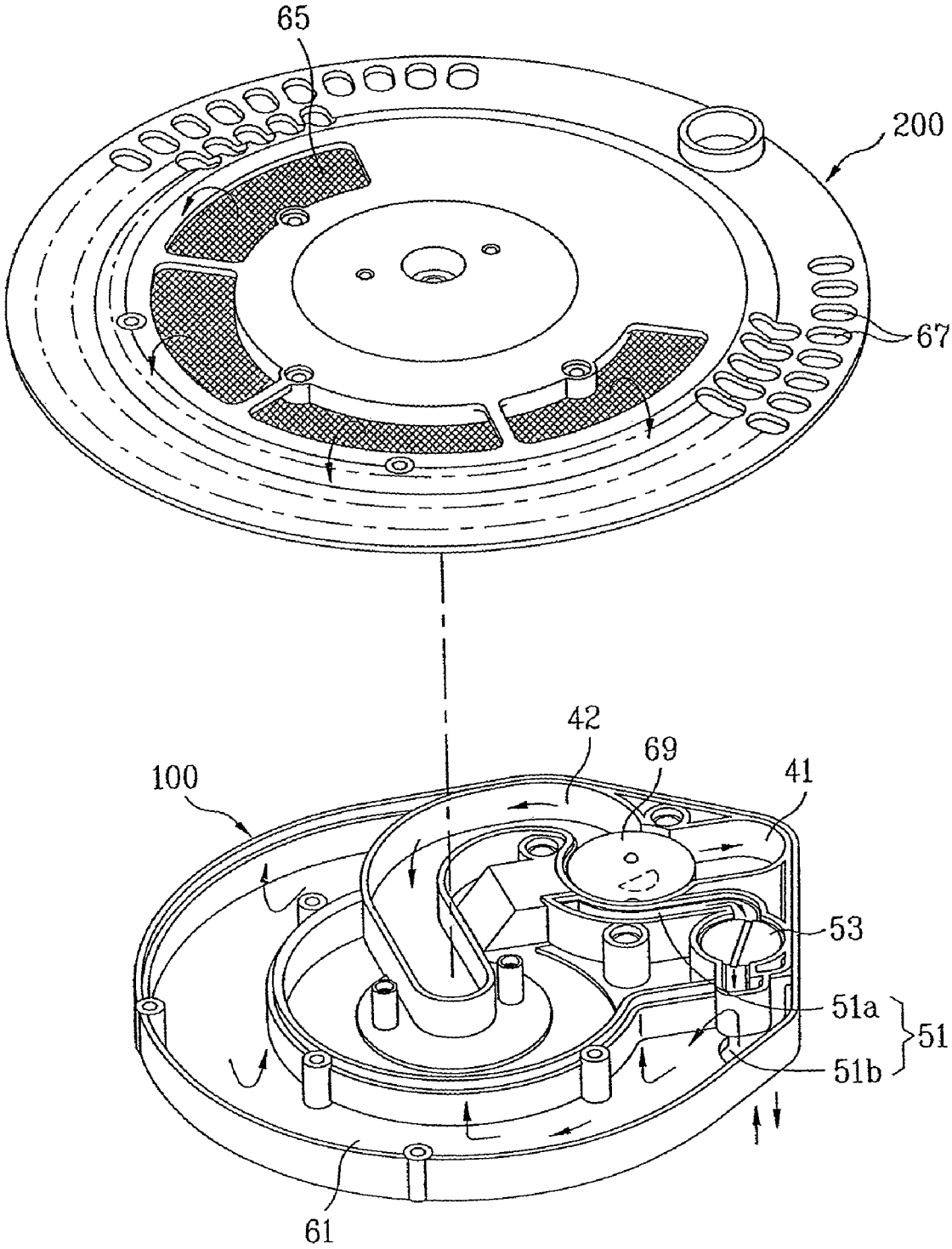
FIG. 5 illustrates an exploded perspective view of the housing and a cover of the water recirculator of FIG. 3.

Meanwhile, as shown in FIGS. 3 and 5, a cover 200 is provided above the housing 100. The cover 200 covers the reservoir 61 and the guide passage 40 (i.e., the first guide passage 41 and the second guide passage 42). And, the main filter 65 which can filter the water overflowing from the reservoir 61 is provided at the cover 200. The water, which overflows from the reservoir 61 and passes through the main filter 65, flows on an upper surface of the cover 200 and then falls down into the sump 20 provided under the housing 100. Accordingly, at least one hole 67 is provided at the cover 200. Preferably, a plurality of the holes 67 is disposed along a circumferential portion of the upper surface of the cover 200, as shown in FIG. 5. The holes 67 guide the filtered water, which passes through the main filter 65, into the sump 20. Also, the holes 67 guide the contaminated water, which is fallen down from the washing chamber 10 after washing the dishes, into the sump 20. However, the holes 67 may not be provided at the cover 200. For example, the cover 200 may have a small diameter so that the water passing through the main filter 65 can be fallen from a circumference of the cover 200 and into the sump 20. In this case, the water fallen from the washing chamber 10 may fall directly into the sump.

Meanwhile, the drain pump 55 is connected to the sump 20, as shown in FIG. 3. And, the first bypass 51*a* connects the drain pump 55 to the inlet 63, and the second bypass 51*b* connects the drain pump 55 to the reservoir 61, as shown in FIG. 3. In this case, the drain pump 55 is provided below the housing 100 and, more particularly, below the reservoir 61. And, the supplementary filter 57 having the mesh coarser than that of the main filter 65 is provided in the drain pump 55. In addition, although it does not illustrated in FIG. 3, the supplementary bypass 70 (shown in FIG. 2) is provided, thereby allowing the sump 20 to be communicated with the bypass 51 and, more particularly, with the first bypass 51*a*. When the supplementary bypass 70 is provided as mentioned above, deformation of the main filter 65 can be prevented. Also, the waste of water caused by an inadequate measurement of the level of contamination of the water by the sensor 53 can also be prevented.

Generally, the water pressure in the reservoir 61 increases when a large quantity of contaminants remains in the reservoir 61 and the contaminants cling to the main filter 65. However, contaminants being light in weight but large in size cling to and temporarily cover a large portion of the surface of the main filter 65, even when the water is not heavily contaminated. Then, the main filter 65 becomes clogged causing the water pressure in the reservoir 61 to increase rapidly and suddenly. In this case, as mentioned above, if the upper spray arm 14 continues to spray a portion of the water to the main filter 65 and removes the clinging contaminants from the main filter 65, the water pressure in the reservoir 61 decreases. However, the process of detaching (or washing out) the clinging contaminant from the main filter 65 is time consuming. Consequently, the water cannot flow toward the reservoir 61 and may flow backward, instead. In this case, a lot of contaminants may flow backward from the reservoir 61 along with the back flow of the water, and the sensor 53 may instantly detect a heavy contamination level in the water. Accordingly, the drain pump 55 and the drain valve 85 are activated, and the water accommodated in the sump 20 and the reservoir 61 is drained, thereby wasting a large amount of water.

However, if the supplementary bypass 70 is provided, the supplementary bypass 70 allows the sump 20 to be communicated with the bypass 51, instead of allowing the drain pump 55 to be communicated with the drain valve 85, thereby preventing the water pressure in the reservoir 61 from exceeding the predetermined water pressure when the main filter 65 is clogged. Then, since the water introduced through the first bypass 51*a* returns to the sump 20 through the supplementary bypass 70, the water pressure in the reservoir 61 decreases, and the contaminants clinging to the main filter 65 are removed by spraying water from the lower spray arm 14. Consequently, the level of the water measured by the sensor 53 decreases rapidly and suddenly. Then, the supplementary bypass 70 is closed, and the water is supplied to the reservoir 61 once again. As described above, if the supplementary bypass 70 is provided, the waste of water can be effectively prevented. However, if the level of contamination of the water does not decrease, then the water remains heavily contaminated. Accordingly, the drain pump 55 and the drain valve 85 are activated, so as to drain the water outside of the dishwasher by force.

Meanwhile, in the housing 100 according to the first embodiment of the present invention as described referring to FIGS. 3 to 5, the guide passage 40 and the reservoir 61 are provided at the same height. Herein, since an extent or a width of the housing 100 is limited, the first guide passage 41 and the second guide passage 42 inevitably occupy a large portion of the space inside the reservoir 61. Therefore, the amount of the water that can be accommodated in the reservoir 61 is reduced, and the area of the main filter 65 covering the upper part of the reservoir 61 is also reduced. Eventually, the filtering capability of the main filtering unit 60 is reduced.

In addition, as shown in FIG. 4, the reservoir 61 has two closed ends each being blocked by the guide passage 40 and the first bypass 51*a*. Thus, the contaminants are accumulated at the closed ends of the reservoir 61, and the accumulated contaminants disturb the drainage of the water. Thus, the second embodiment may resolve the problems caused in the first embodiment.

Figure 6:
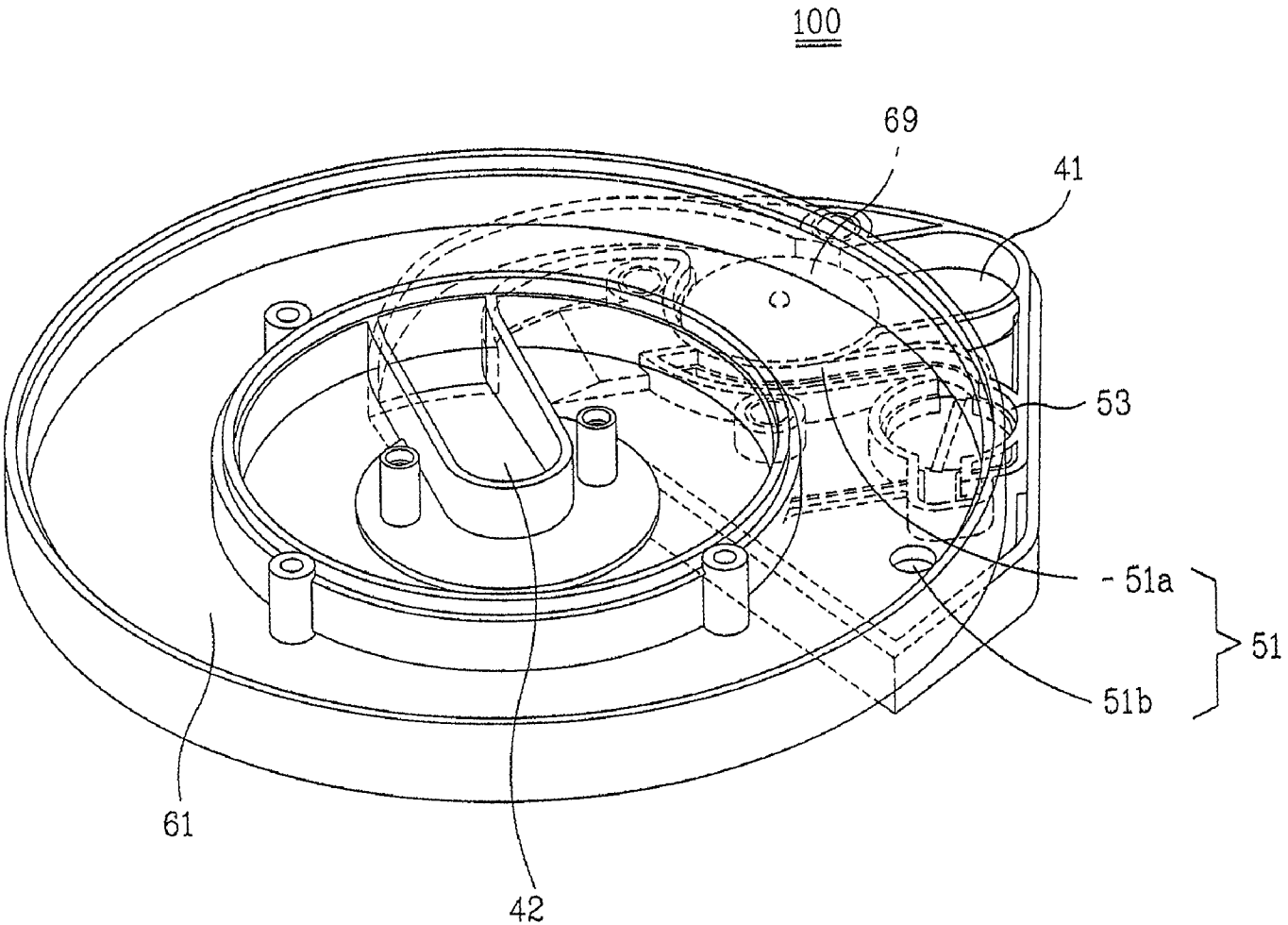
FIG. 6 illustrates a perspective view of the housing of the water recirculator according to a second embodiment of the present invention.
Figure 7:
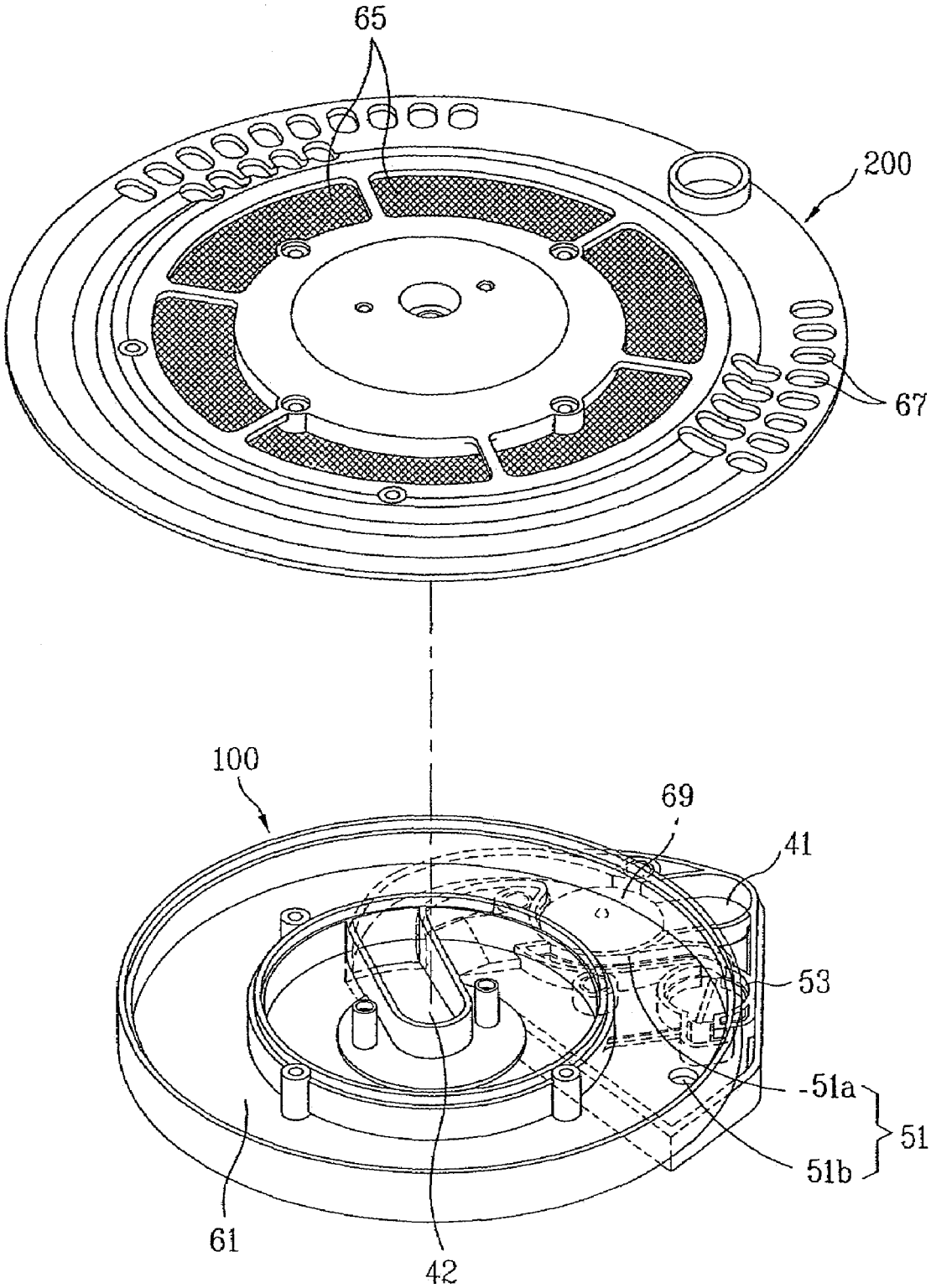
FIG. 7 illustrates an exploded perspective view of the housing and the cover of the water recirculator of FIG. 6.

FIGS. 6 and 7 illustrate a housing 100' according to the second embodiment of the present invention. The description for identical members of the water recirculator according to the present invention will be omitted for simplicity. Referring to FIGS. 6 and 7, the reservoir 61' and the guide passage 40 (i.e., the first guide passage 41 and the second guide passage 42) are provided at different heights. More particularly, the reservoir 61' is provided above the guide passage 40. In this case, since the first and second guide passages 41 and 42 are located below the reservoir 61' and covered by a lower part of the reservoir 61', the first and the second guide passages 41 and 42 do not occupy any space within the reservoir 61'. In other words, each of the water reservoir 61' and the guide passage 40 occupies a different vertical space of the housing 100'. Thus, the size of the reservoir 61 can be enlarged, and the area of the main filter 65', which is provided at the cover 200' covering the reservoir 61', can also be enlarged.

Herein, the guide passage 40 (i.e., the first and second guide passages 41 and 42) and the spray arms (i.e., the upper and lower spray arms 13 and) 14 should be connected, respectively. Accordingly, any one of the first and second guide passages 41 and 42 may pass through a part of the reservoir 61', and then may be connected to any one of the upper and lower spray arms 13 and 14. The other one of the first and second guide passages 41 and 42 may protrude toward the outside of the reservoir 61' and, then, may be connected to the one of the upper and lower spray arms 13 and 14.

For example, as shown in FIGS. 6 and 7, the second guide passage 42 may pass through a center of the reservoir 61', and then may be connected to the lower spray arm 14 through the lower connection tube 16. Accordingly, the reservoir 61' may have a looped curved shape, such as a circular ring or an oval ring, when the reservoir 61' is seen from above, as shown in FIG. 6. Thus, the first guide passage 41 may protrude toward the outside of the reservoir 61' and, then, may be connected to the upper spray arm 13 through the upper connection tube 15.

Meanwhile, when the housing 100' is formed as shown in FIGS. 6 and 7, the reservoir 61' may have a width as large as that of the housing 100'. Therefore, the size (or volume) of the reservoir 61' and the area of the main filter 65' are increased, respectively. Accordingly, the amount of water accommodated in the reservoir 61' is increased, and the filtering capability of the main filter 65' is enhanced. Therefore, the clogging of the main filter 65' can be prevented, and the amount of water used for washing the dishes can be reduced because the main filter 65' can filter the washing water during a long period of time without draining and re-supplying the water.

The operation of the water recirculator according to the present invention will now be described in detail. When operating the dishwasher, fresh and clean water is supplied to the sump 20. And, when the water supply pump is activated, the water in the sump 20 is introduced to the inlet 63 of the housing 100 or 100'. The diverting valve 69 guides a portion of the water introduced to the inlet 63 to both or any one of the first guide passage 41 and the second guide passage 42, either simultaneously or selectively. Thus, both or any one of the upper spray arm 13 and the lower spray arm 14 spray the portion of the water and wash the dishes placed on the both or any one of the upper rack 11 and the lower rack 12.

After washing the dishes at the washing chamber 10, the contaminated water falls down on the cover 200 or 200', passes through the hole 67, and is held in the sump 20. The sump 20 also holds the contaminants formed during the washing process along with the water. On the other hand, the rest of the water introduced to the inlet 63 of the housing 100 or 100', after being pumped up from the sump 20, is always introduced to the first bypass 51*a* regardless of the operation of the diverting valve 69. And, the sensor 53 measures the level of contamination of the water, which moves through the first bypass 51*a*, and transfers the data related to the level of the contamination of the water to a controller (not shown). If the water is not heavily contaminated, the controller does not operate the drain pump 55 and the drain valve 85. Thus, the water introduced through the first bypass 51*a* is introduced into the drain pump 55, and coarse contaminants included in the water introduced into the drain pump 55 are precipitated in the drain pump 55 and filtered by the supplementary filter 57.

The water passing through the drain pump 55 is introduced into the reservoir 61 or 61' through the second bypass 51*b*. And, when a large amount of the water is introduced into the reservoir 61 or 61', the water overflows from the reservoir 61 or 61'. At this point, the main filter 65 or 65' at the cover 200 or 200' filters fine contaminants included in the water overflowing from the reservoir 61 or 61'. And, the filtered water is introduced into the sump 20 through the holes 67 provided at the cover 200 or 200', and the coarse contaminants that are unable to pass through the main filter 65 or 65' remain in the reservoir 61 or 61'.

Meanwhile, when the water pressure in the reservoir 61 or 61' becomes higher than the predetermined water pressure because of the large amount of the contaminants remaining in the reservoir 61 or 61', the supplementary bypass 70 allows the sump 20 to be communicated with the first bypass 51*a*, so as to return the water to the sump 20 and to prevent the deformation of the main filter 65 or 65'.

Conversely, if the water is heavily contaminated, the controller operates the drain pump 55 and the drain valve 85. Then, water in the sump 20 is drained outside of the dishwasher through the drain passage 80 and the drain pump 55. And, the contaminated water and the contaminants in the reservoir 61 or 61' are also drained outside of the dishwasher through the second bypass 51*b* and the drain pump 55.

Meanwhile, as mentioned above, the water recirculator according to the present invention filters only the water which is pumped by the water supply pump 30 and is introduced into the reservoir 61 or 61' through the bypass 51 and the drain pump 55. Accordingly, although it may seem that only a portion of the water is filtered, almost all of the water is filtered during the washing cycle.

The water recirculator according to the present invention has the following advantages. The water recirculator initially filters coarse contaminants at the pre-filtering unit, and then secondly filters fine contaminants at the main filtering unit. Therefore, the main filtering unit is prevented from being clogged and deformed. And, the filtering capability of the main filtering unit is enhanced. Consequently, since a time period for exchanging the contaminated water into fresh water can be extended, excessive waste of water and energy for heating the water can also prevented.

In addition, since the supplementary bypass is provided between the sump and the pre-filtering unit, such that the supplementary bypass can allow the sump and the bypass to be communicated with each other when the water pressure in the reservoir is higher than the predetermined water pressure, the deformation of the main filter caused by high water pressure and the waste of the water can be prevented.

Furthermore, since a plurality of members, such as the guide passage and the reservoir, is provided at the housing, the water recirculator according to the present invention can be formed to have a compact size. And, finally, if the reservoir is provided above the guide passage, since the reservoir and the main filter can be enlarged, the filtering capability of the main filter can be enhanced, thereby preventing waste of water and energy.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A water recirculator in a dishwasher, comprising:

a sump for holding water;

a water supply pump connected to the sump and pumping the water;

at least one filtering unit precipitates or filters contaminants in part of the water pumped by the water supply pump in the order proportionate in size or weight of contaminants; and, a spray arm spaying a remaining part of the water pumped by the water supply pump wherein the filtering unit includes a precipitating space and two filters, wherein the precipitating space is located below the filters, wherein the part of the water pumped by the water supply pump flows into the precipitating space before passing through the filters and wherein one of the filters is coarser than the other filter and the coarser filter is located below the other filter, and wherein the part of the water pumped by the water supply pump passes through the precipitating space, the coarser filter and the other filter sequentially.

2. The water recirculator as claimed in claim 1, wherein the coarser filter is located at the outlet of the precipitating space.

3. The water recirculator as claimed in claim 1, further comprising a drain pump capable of draining the water in the sump, and wherein the precipitating space is inner space of the drain pump.

4. The water recirculator as claimed in claim 3, wherein the contaminant precipitated in inner space of the drain pump are drained when the drain pump operates.

5. A water recirculator in a dishwasher, comprising:

a sump for holding water;

a water supply pump connected to the sump and pumping the water;

a guide passage for guiding a portion of the pumped water to a spray arm in a washing chamber;

a bypass for guiding the rest of the water pumped by the water supply pump to a precipitating space located below the water supply pump; and, a supplementary bypass being communicated with the bypass and the sump, for being capable of making the sump to be communicated with the bypass.

6. The water recirculator as claimed in claim 5, further comprising two filters filtering contaminants in the water flowing from the precipitating space.

7. The water recirculator as claimed in claim 6, wherein one filter is coarser than the other filter and wherein the coarser filter is located between the precipitating space and the other filter.

8. The water recirculator as claimed in claim 7, further comprising a reservoir for holding the water passed through the coarser filter, wherein the other filter is provided above the reservoir for purifying the water which overflows from the reservoir and returns to the sump.

9. The water recirculator as claimed in claim 7, wherein the coarser filter is located at the outlet of the precipitating space.

10. The water recirculator as claimed in claim 5, further comprising a drain pump capable of draining the water in the sump and including an impeller and an impeller housing surrounding the impeller, and wherein the precipitating space is inner space of the impeller housing.

11. A water recirculator in a dishwasher, comprising:

a sump for holding water;

a water supply pump connected to the sump and pumping the water;

a guide passage for guiding a portion of the water pumped from the sump to a spray arm provided in a washing chamber;

a pre-filtering unit precipitating coarse contaminants contained in a rest of the water pumped from the sump to purify and comprising an inlet connected to the water supply pump, an outlet and a first filter for removing contaminants not precipitated;

a main filtering unit comprising a reservoir connected to the outlet of the pre-filtering unit, having an opening at an upper portion and receiving the water passed through the pre-filtering unit and a second filter provided at the opening and removing finer contaminants from the water returning to the washing chamber; and, a bypass connecting the supply pump to the inlet of the pre-filtering unit and the outlet of the pre-filtering unit and the main filtering unit, and guiding the rest of the water pumped by the water supply pump to the main filtering unit bypassing the pre-filtering unit.

12. The water recirculator as claimed in claim 11, wherein the main filtering unit removing finer contaminants from the water returning to the washing chamber by overflowing the water through the second filter.

13. The water recirculator as claimed in claim 11, wherein the outlet of the pre-filtering unit being provided at upper portion of the pre-filtering unit.

* * * * *